US007267379B2

(12) United States Patent
Rusiana

(10) Patent No.: US 7,267,379 B2
(45) Date of Patent: Sep. 11, 2007

(54) FLUSH BOLT

(75) Inventor: Arturo D. Rusiana, Algonquin, IL (US)

(73) Assignee: Architectural Builders Hardware Mfg., Inc., Itasca, IL (US)

( * ) Notice: Subject to any disclaimer, the term of this patent is extended or adjusted under 35 U.S.C. 154(b) by 65 days.

(21) Appl. No.: 11/083,206

(22) Filed: Mar. 17, 2005

(65) Prior Publication Data

US 2006/0208499 A1 Sep. 21, 2006

(51) Int. Cl.
*E05B 63/20* (2006.01)
*E05C 1/02* (2006.01)

(52) U.S. Cl. ..... 292/332; 292/137; 292/169; 292/150; 292/333; 292/DIG. 21; 292/DIG. 44

(58) Field of Classification Search ..... 292/332, 292/24, 32, 37, 92, 137, 140, 150, 159, 177, 292/179, 182, 163, 169, 333, DIG. 15, DIG. 21, 292/DIG. 44, DIG. 51, DIG. 61, 34, 341.16
See application file for complete search history.

(56) References Cited

U.S. PATENT DOCUMENTS 1,338,713 A * 5/1920 Toney ..... 292/335
1,490,777 A * 4/1924 La Fortune ..... 292/166
1,647,921 A * 11/1927 Levinson ..... 292/173
2,202,916 A * 6/1940 Mussa ..... 292/177
2,547,546 A * 4/1951 Stulpin et al. ..... 292/166
3,578,369 A * 5/1971 Coopersmith ..... 292/58
3,582,122 A * 6/1971 Foster et al. ..... 292/335
3,792,884 A * 2/1974 Tutikawa ..... 292/37
4,005,886 A 2/1977 Lirette
4,049,304 A * 9/1977 Imhoff ..... 292/333
4,099,753 A * 7/1978 Gwozdz et al. ..... 292/177
4,445,717 A 5/1984 Imhoff
4,601,502 A * 7/1986 Van Dyke ..... 292/252
4,611,840 A 9/1986 Martin
5,004,277 A 4/1991 Campbell et al.
5,005,881 A * 4/1991 Bailey et al. ..... 292/45
5,076,620 A 12/1991 Campbell et al.
5,120,093 A * 6/1992 Carney ..... 292/60
5,527,074 A * 6/1996 Yeh ..... 292/177
5,931,515 A * 8/1999 Stendal ..... 292/153
6,283,513 B1 * 9/2001 Yeh ..... 292/92
6,409,231 B1 * 6/2002 Rusiana ..... 292/33
6,883,837 B1 * 4/2005 Lin ..... 292/33

* cited by examiner

*Primary Examiner*—Carlos Lugo
(74) *Attorney, Agent, or Firm*—Greer, Burns & Crain, Ltd.

(57) ABSTRACT

A flush bolt includes a bolt head and a strike. The bolt head moves out of the flush bolt in response to movement of the strike into the flush bolt, through a movable cam surface in the flush bolt. The bolt head is withdrawn towards the flush bolt when the strike is released.

3 Claims, 6 Drawing Sheets

FLUSH BOLT

This invention relates to flush bolts, and more particularly, to flush bolts having bolt heads that are operated by a cam surface in a door strike assembly.

BACKGROUND OF THE INVENTION

Flush bolts are used to lock one of the doors in a double door set, such as those used in hospitals and schools where wide exits are needed. The door with the flush bolt is closed first. When the other door is closed, the flush bolt locks the first door in place. When the other door is opened, the flush bolt automatically unlocks the first door, so that it can be opened, too, if desired.

The flush bolt includes a bolt head that extends from the top or bottom of the first door, and a strike that extends from the edge of the door that faces the other door when the two doors are closed. The strike is spring loaded in a strike assembly, and is depressed when the second door closes flush with the first door. The strike is similar to conventional latches that enter a door jamb, but in a flush bolt the strike is kept in the strike assembly when the door is closed, and does not enter the second door.

As the strike is pressed into the first door, the bolt head is pushed out of the door into a lock cavity in the door frame. However, the linkage between the strike and the bolt head in conventional flush bolts is fairly complex and expensive. Thus, there is a need for flush bolts having simpler construction.

SUMMARY OF THE INVENTION

The above-listed need is addressed by a flush bolt having a simple construction. The flush bolt includes a bolt head and a strike. The bolt head moves out of the flush bolt in response to movement of the strike into the flush bolt, through a movable cam surface in the flush bolt. The bolt head is withdrawn towards the flush bolt when the strike is released.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
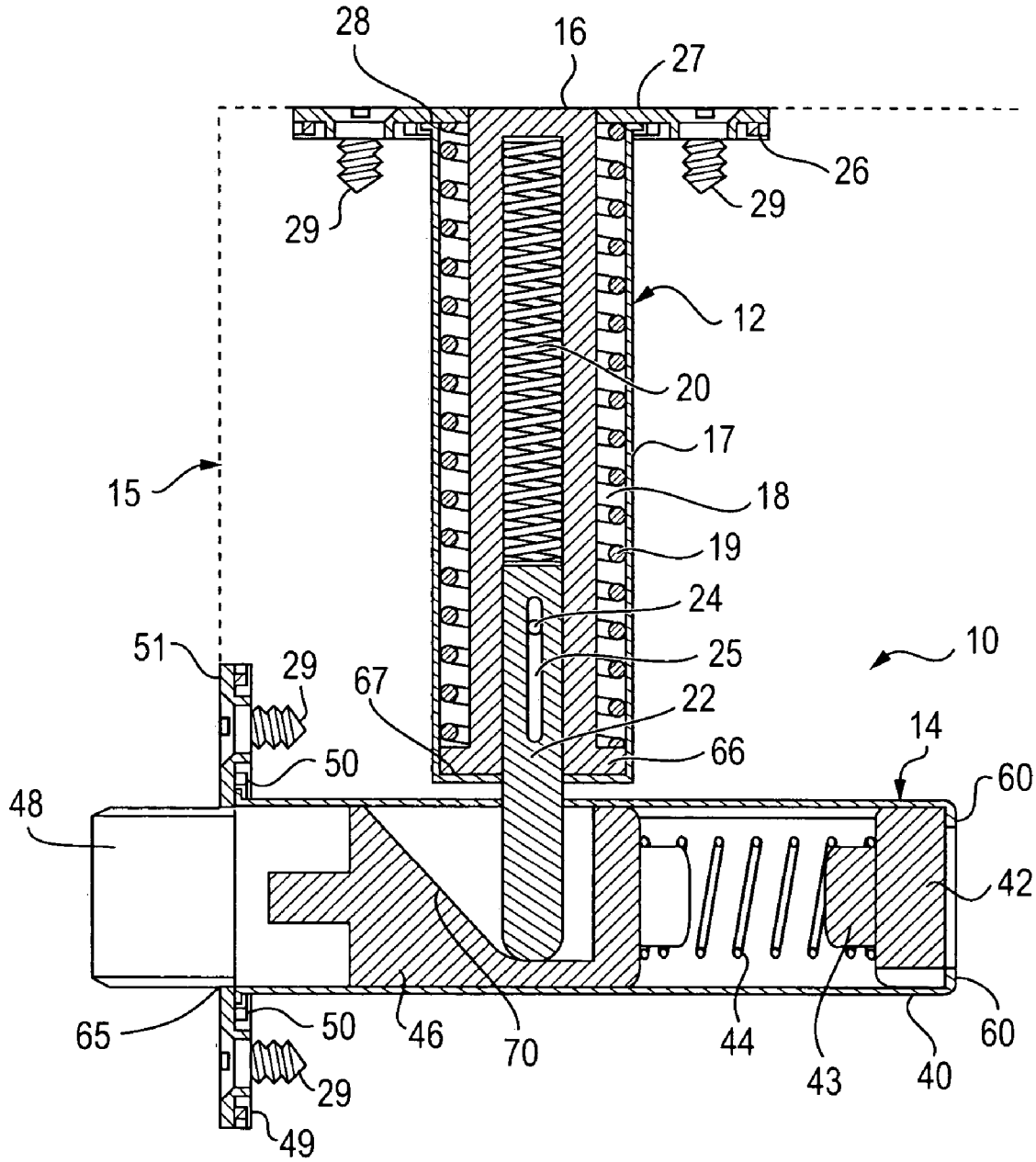
FIG. 1 is a cut-a-way side view of a flush bolt made in accordance with the present invention, shown with the strike extended and the bolt head withdrawn.
Figure 2:
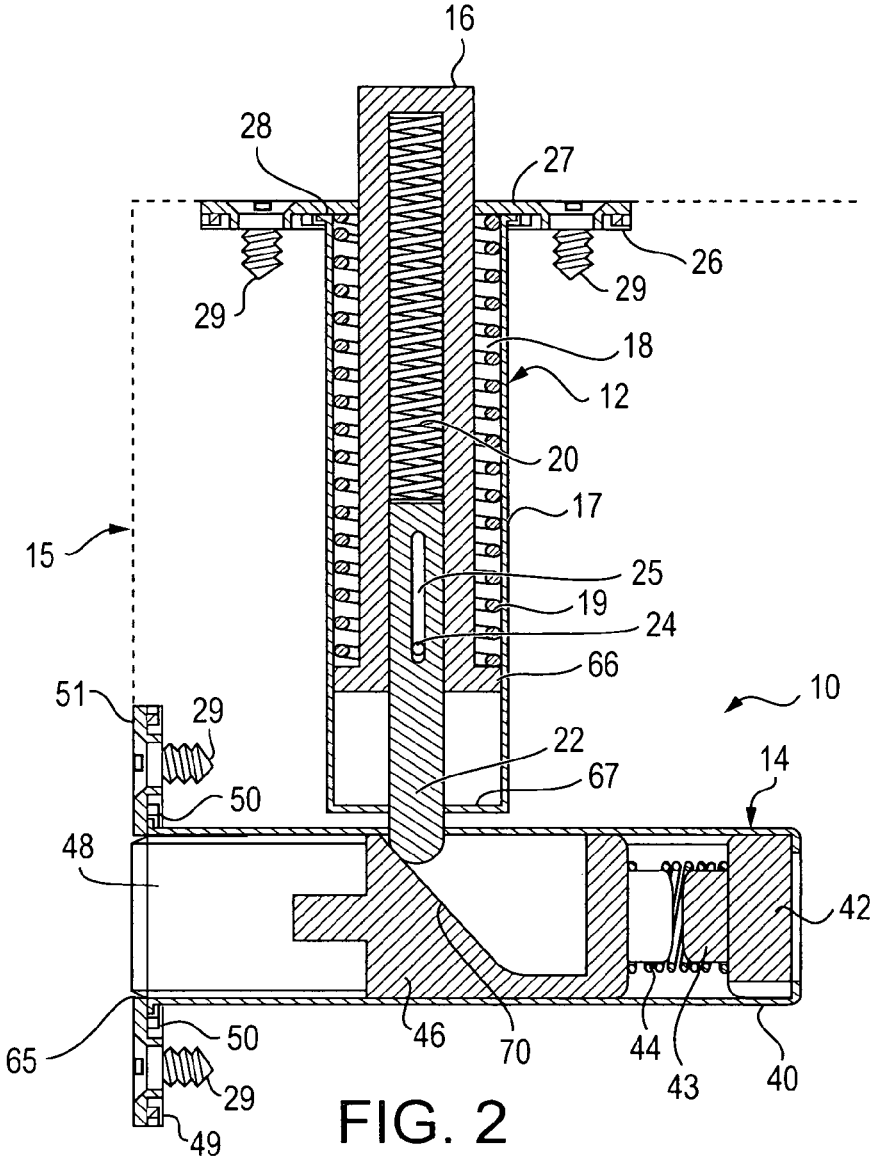
FIG. 2 is a cut-a-way side view of the flush bolt of FIG. 1, shown with the strike depressed and the bolt head extended.

As seen in FIGS. 1 and 2, a flush bolt 10 includes a bolt assembly 12 and a strike assembly 14. The flush bolt 10 is shown installed in a door 15.

The bolt assembly 12 has a bolt head 16 that can be selectively withdrawn into the door 15 or pushed out of the door 15 (and preferably pushed into a door jamb in an adjoining door frame (not shown)) to release and lock the door 15 in the door jamb, respectively. The bolt head 16 is typically installed in the top or bottom of the door 15.

In addition to the bolt head 16, the bolt assembly 12 includes a housing 17 having a cavity 18, a compression spring 19, an override spring 20, a plunger 22 in a cavity in the bolt head 16, and a pin 24, such as a cotter pin. The pin 24 is secured in openings (not shown) in the housing 17, and passes through a slot 25 in the plunger 22. The pin 24 allows movement of the plunger 22 within a desired range, yet prevents the plunger 22 from escaping completely out of the housing 17. A bolt head guide 26 and a back plate 27 are swaged together over an extending edge 28 in the housing 17, to secure the other components in the bolt assembly 12. Screws 29 secure the bolt assembly 12 in the door 15.

The strike assembly 14 includes a barrel 40, an end plug 42 with a boss 43, a compression spring 44, a cam 46 and a strike 48. A back plate 49, two spacers 50 and a dress plate 51 are also provided.

Figure 3B:
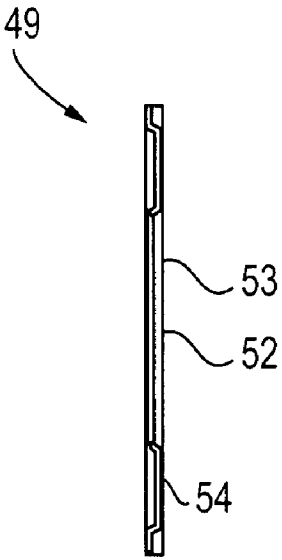
FIG. 3B is a side view of the back plate of FIG. 3A.
Figure 3A:
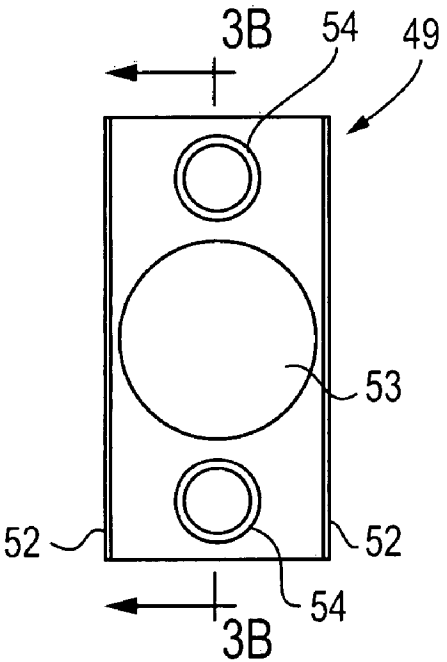
FIG. 3A is a front view of a back plate used with the flush bolt of FIG. 1.

The back plate 49 is shown in greater detail in FIGS. 3A and 3B. The back plate 49 has somewhat upturned edges 52 in the longitudinal direction, a main opening 53, and mounting openings 54. The material surrounding the mounting openings 54 can be raised slightly, as seen in FIG. 3B.

Figure 4:
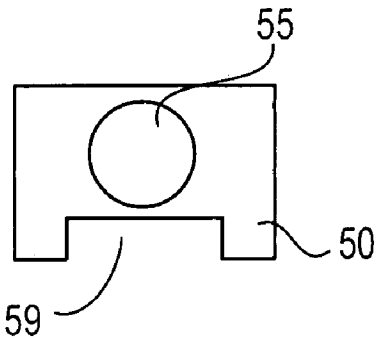
FIG. 4 is a front view of a spacer used in the flush bolt of FIG. 1.

The spacers 50 are shown in FIG. 4. The spacers 50 fit between the edges 52 of the back plate 49. Openings 55 fit over the openings 54.

Figure 5B:
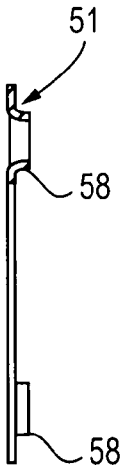
FIG. 5B is a side view of the dress plate of FIG. 5A.
Figure 5A:
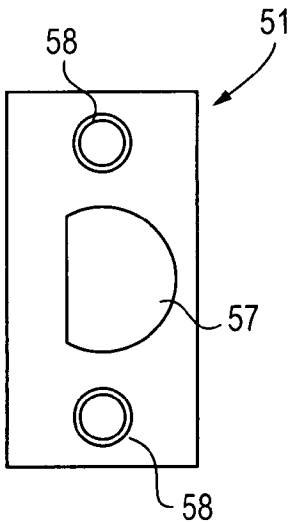
FIG. 5A is a front view of a dress plate used in the flush bolt of FIG. 1.

The dress plate 51, shown in greater detail in FIGS. 5A and 5B, includes a large opening 57, through which the strike 48 passes, and mounting openings 58, which line up with the openings 55 (FIG. 4) and 54 (FIG. 3A). The material around the openings 58 go through the openings 54 and 55, though, and is swaged to secure the dress plate 51 to the back plate 49, after the barrel 40 is inserted through the back plate opening 53. This also secures the spacers 50 in place.

Figure 6A:
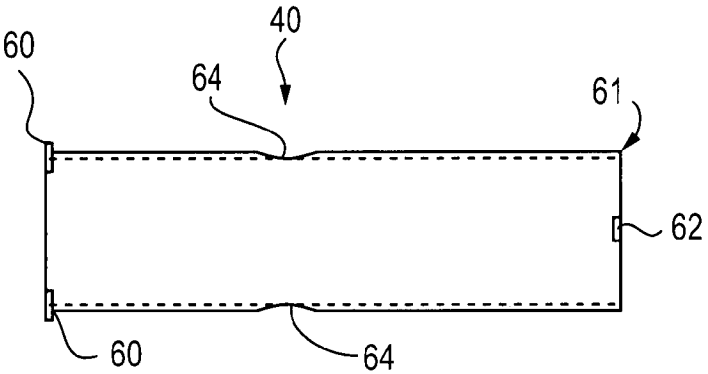
FIG. 6A is a side view of a barrel used in the strike assembly of the flush bolt of FIG. 1.
Figure 6B:
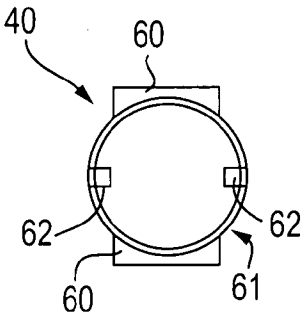
FIG. 6B is an end view of the barrel of FIG. 6A.

The spacers 50 also have a cut out 59, and the barrel 40 has flanges 60, as seen in FIGS. 6A and 6B. The flanges 60 fit into the cut outs 59 when the strike assembly 14 is assembled, and align the flanges 60.

The barrel 40 (FIGS. 6A and 6B) has a back end 61 opposite the front end, which has the flanges 60. As seen in FIG. 6B, the back end 61 is generally open, with two opposed ears 62 extending into the opening at the back end 61.

Figure 7B:
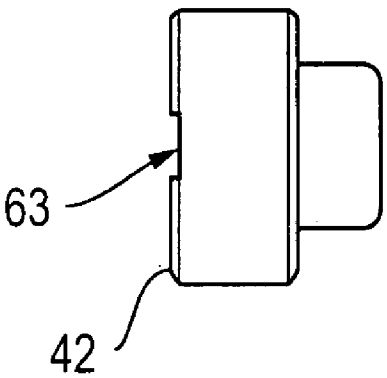
FIG. 7B is a side view of the plug of FIG. 7A.
Figure 7A:
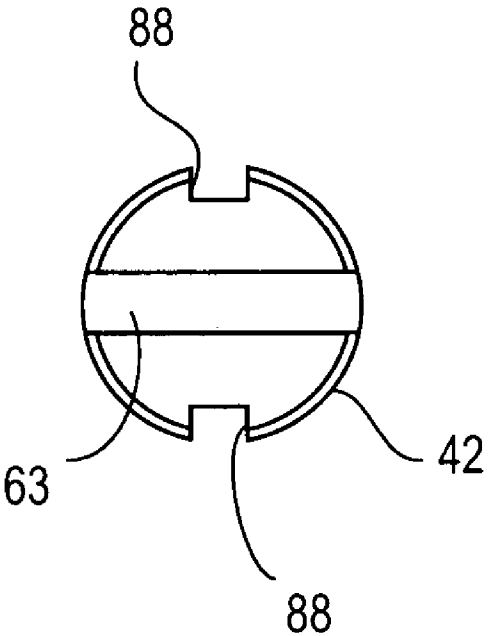
FIG. 7A is an end view of an end plug used in the flush bolt of FIG. 1.

When the strike assembly 14 is assembled, the end plug 42 is placed in the barrel 40, as seen in FIGS. 1 and 2. As seen in FIGS. 7A and 7B, the end plug 42 has an elongated depression 63 which is wide enough to accept the ears 62, securing the end plug 42 in place in the barrel 40. The spring 44 can then be easily inserted into the barrel 40, followed by the cam 46 and the strike 48. The back plate 49 can be slid over the barrel 40, and the spacers 50 can be placed on the front side of the back plate 49, with the openings 54 and 55 aligned. The flanges 60 on the barrel 40 fit into the cutouts 59 in spacers 50. Among other things, this aligns openings 64 (FIG. 6A) in the barrel 40 with respect to the back plate 49 (and plunger 22 when installed in a door). The dress plate 51 is then placed over the spacers 50, with the openings 58 aligned with the openings 54 and 55. Of course, the opening 57 is aligned with the strike 48 so that the strike 48 passes through the opening 57, as seen in FIGS. 1 and 2.

Assembly of the strike assembly 14 is completed by swaging. The material around the openings 58 in the dress plate 51 permanently secures the dress plate 51 to the back plate 49. The dress plate 51 secures the strike assembly 14 in the door, but has an opening 65 that allows the strike 48 to pass through the dress plate. A ledge or other suitable offset (not shown) limits movement of the strike and prevents it from going too far out of the strike assembly.

Referring again to the bolt assembly 12, the compression spring 19 is secured on one end by the back plate 27. The other end of the spring 19 presses against a lip 66 on the bolt 16. The spring 19 generates a spring force which pushes the lip 6 against a bottom 67 of the housing 17 in the absence of counteracting forces which will be described. The bottom 67 can be any suitable structure, such as tongues, that sufficiently fix the resting position of the bolt head 16, but is open enough to allow passage of the plunger 22 through the bottom 67. In this manner, the compression spring 19 withdraws the bolt 16 into the bolt assembly 12. In this state, the flush bolt does not lock the door 15 in place.

When the plunger 22 is raised, as in FIG. 2, the plunger 22 compresses the override spring 20, which generates enough spring force to overcome the force of the compression spring 19. Under normal circumstances, this spring force pushes the bolt head 16 out of the bolt assembly 12, and into an adjoining door jamb to lock the door 15 in place. If the bolt head 16 jams in the door frame for any reason and does not enter the door jamb, however, the override spring 20 is still compressed, allowing the plunger 22 to move to the position shown in FIG. 2 without damaging the flush bolt.

Referring again to the strike assembly 14, one end of the spring 44 is held in place by the boss 43 on the end plug 42, and the other end of the spring 44 presses against the cam 46. The cam 46 is operatively connected to the strike 48. The spring 44 creates spring force that normally presses the strike 48 through the opening 65 in the dress plate 51, and out of the strike assembly 14, as in FIG. 1. However, when a second door 68 (FIG. 8) is closed adjacent to the door 15, the strike 48 is pressed into the strike assembly 14, as in FIG. 2, which pushes the cam 46 further inside the barrel 40, further compressing the spring 44. The door 68 can have a strike plate, but the strike plate will not have an opening for latching purposes, as the strike 48 remains depressed when the doors are closed.

Figure 9A:
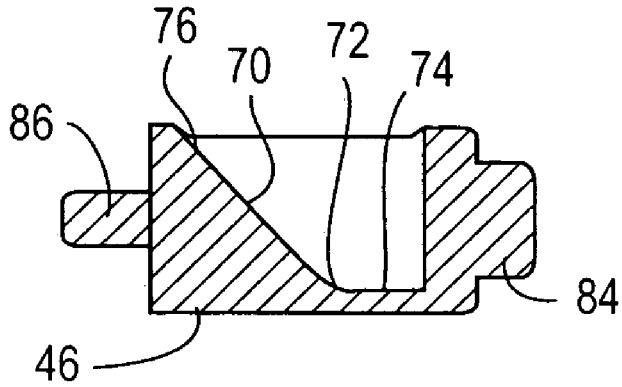
FIG. 9A is a cutaway side view of a cam used in the flush bolt of FIG. 1; 20.
Figure 9B:
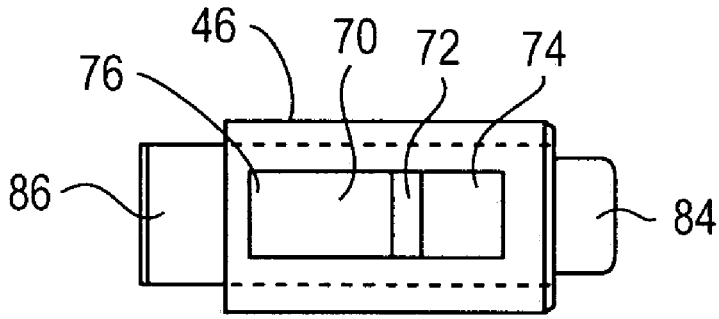
FIG. 9B is a top view of the cam of FIG. 9A.
Figure 9C:
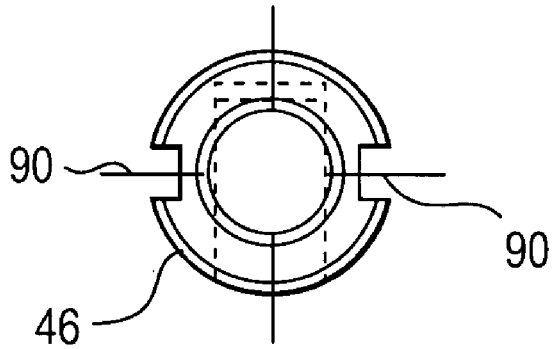
FIG. 9C is an end view of the cam of FIG. 9A.

The cam 46 includes a cam surface 70, also shown in FIGS. 9A, 9B and 9C. The cam surface 70 has a low end 72 which joins a flat surface 74, and a high end 76. When the strike 48 is released out of the door 15 and strike assembly 14, as in FIG. 1, the cam 46 is pushed towards the dress plate 51, so that the plunger 22 rests on or adjacent to the flat surface 74. This reduces the spring force generated by the spring 20 enough to allow the force of the compression spring 19 to withdraw the bolt head 16 into the housing 17, leaving the flush bolt 10 in an unlocked configuration.

Figure 8:
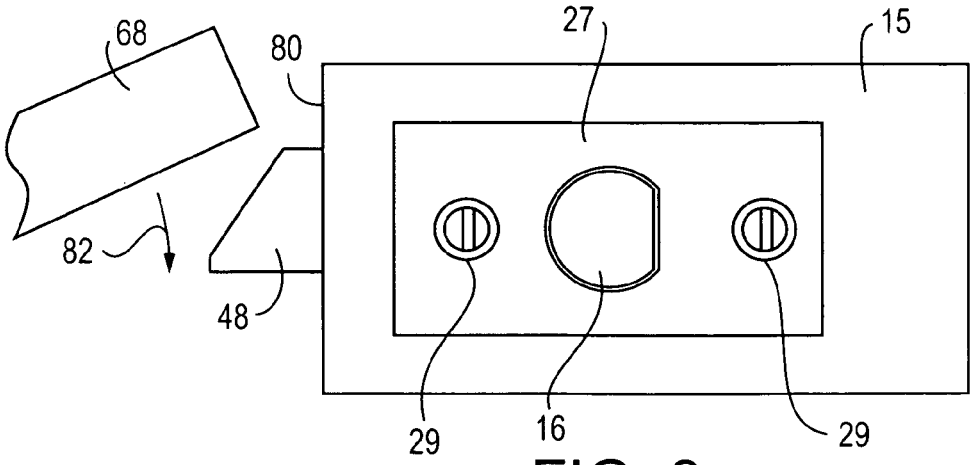
FIG. 8 is an end view of the flush bolt of FIG. 1, showing the flush bolt installed in a closed first door, as a second door is closed adjacent the first door.

When the adjacent door 68 is oriented towards an edge 80 in the door 15, by closing the adjacent door 68 in the direction shown in FIG. 8 by an arrow 82, the strike 48 is pressed into the strike assembly 14, as seen in FIG. 2. The cam 46 is forced further inside the barrel 40, compressing the spring 44. The plunger 22 is forced upwardly by the cam surface 70 in the cam 46, increasing the spring force of the spring 20 enough to overcome the force of the compression spring 19, and forcing the bolt head 16 out of the bolt assembly 12 and into the adjacent door jamb. As explained previously, if the bolt head 16 cannot enter the doorjamb for any reason, the plunger 22 can still be pushed upwardly by the cam surface 70, allowing the strike 48 to continue operating.

Referring again to FIGS. 9A and 9B, the cam 46 has an end 84 configured to accept and hold the spring 44 in place on one end, and a projection 86 that enters a mating cavity in the strike 48. The projection 86 aligns the cam 46 with one of the openings 64 in the barrel 40, so that the plunger 22 properly extends into the cam 46.

The strike assembly 14 shown in FIGS. 1 and 2 is shown assembled to close the second door 68 from left to right in FIG. 8. The strike assembly 14 can be easily disassembled and reassembled to accommodate a door 68 that closes from right to left, though, in the following manner. Referring again to FIG. 7A, the end plug 42 can be easily pressed into the barrel 40 through the back end 61, releasing the depression 63 from the ears 62. The end plug 42 can then be rotated 90 degrees, until grooves 88 in the end plug are aligned with the ears 62. When the end plug is released, the spring 44 pushes the end plug out of the strike assembly 14. The spring 44 easily passes through the opening in the back end 61, as well.

The cam 46 also has grooves 90 (FIG. 9C), which are aligned with the tabs 62. This allows the cam 46 to be easily removed from the barrel 40, as well. Strike 48 is not removed.

After removal, the cam 46 can be rotated 180 degrees from the orientation shown in FIG. 1, and placed back in the barrel 40 by passing the grooves 90 over the ears 62. The projection 86 still fits in the cavity in the strike 48, but the cam surface 70 is aligned with the barrel opening 64 on the opposite side of the barrel 40. The spring 44 is easily replaced, and end plug 42 is replaced by aligning the grooves 88 with the ears 62, passing the end plug into the barrel 40, and rotating the end plug 90 degrees to again engage the depression 63 with the ears 62. The strike assembly 14 can then be placed in the door 15, in the manner shown in FIGS. 1 and 2, but the strike 48 will be oriented in the opposite direction, to accommodate a door 68 that closes from right to left in FIG. 8.

The flush bolt 10 is easily installed in a door by drilling two large holes, typically 1 inch in diameter, for the bolt assembly 12 and the strike assembly 14, and screw holes for the back plate 26, dress plate 50 and screws 29. The strike assembly is installed first, followed by the bolt assembly 12.

While the principles of the invention have been described above in connection with specific apparatus and applications, it is to be understood that this description is made only by way of example and not as a limitation on the scope of the invention.

What is claimed is:

1. A flush bolt comprising:

a bolt head and a strike, the bolt head moving out of the flush bolt in response to movement of the strike into the flush bolt, through a movable cam surface in the flush bolt, wherein the bolt head is part of a bolt assembly, and the strike is part of a strike assembly, wherein the movable cam surface is part of the strike assembly, and wherein the bolt assembly further includes, a housing, the bolt head being movable at least partially into and out of the housing, a back plate at an outer end of the housing, a first spring, one end of the first spring pressing against the back plate, the other end of the first spring pressing against a lip at an end of the bolt head, the first spring generating a spring force which withdraws the bolt head into the bolt assembly in the absence of other forces, a plunger in a cavity in the bolt head, the plunger extending through an opening in the bolt assembly adjacent the lip of the bolt head, and into the strike assembly, the plunger engaging the cam surface, and a second spring in the cavity in the bolt head, the second spring extending between the end of the bolt head adjacent the back plate and the plunger, the second spring generating a spring force that presses the plunger partially out of the bolt assembly and into the strike assembly, wherein the spring force generated by the second spring is less than the spring force of the first spring when the plunger is released, but the force of the second spring is greater than the force of the first spring when the plunger is pressed sufficiently far into the bolt head by the cam surface.

2. The flush bolt of claim 1, wherein the cam surface is on a cam, the strike assembly further comprising, a third spring which presses the strike further out of the strike assembly by pressing against the cam, the cam being operatively engaged with the strike, wherein the plunger is located at one end of the cam surface, and the strike extends at least partially out of the strike assembly, in the absence of outside forces, the plunger being pressed further into the bolt assembly when the strike is pressed into the strike assembly, the plunger being moved by engagement with the cam surface.

3. The flush bolt of claim 2 wherein the strike assembly further comprises a barrel, the strike extending through an opening in a first end of the barrel, the opposite end of the barrel having an opening with a plurality of flanges extending towards the opening, the barrel further having a pair of openings through which the plunger in the bolt assembly can pass into and out of the barrel, an end plug adjacent the opposite end of the barrel, the end plug having a depression into which the flanges fit, the end plug having a pair of grooves which are wider than the barrel flanges, the end plug being rotatable so that the end plug can be removed from the barrel when the end plug grooves are aligned with the barrel flanges, the cam having a pair of grooves which are aligned with the barrel flanges for removal of the cam from the barrel after the end plug is removed, and reentry of the cam into the barrel after being rotated 180 degrees, wherein the strike assembly can be disassembled and reassembled to accommodate external pressing of the strike into the strike assembly from either of two sides.

* * * * *